US006514158B1

(12) United States Patent
Nakamura et al.

(10) Patent No.: US 6,514,158 B1
(45) Date of Patent: Feb. 4, 2003

(54) MULTI-PIECE GOLF BALL

(75) Inventors: Atsushi Nakamura, Chichibu (JP); Hisashi Yamagishi, Chichibu (JP); Takashi Maruko, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/492,309

(22) Filed: Jan. 27, 2000

(30) Foreign Application Priority Data

Apr. 1, 1999 (JP) ..... 11-094522

(51) Int. Cl.[7] ..... A63B 37/06
(52) U.S. Cl. ..... 473/378
(58) Field of Search ..... 473/378, 377, 473/376, 373, 374, 371

(56) References Cited

U.S. PATENT DOCUMENTS 4,720,111 A * 1/1988 Yamada ..... 473/378
5,253,871 A * 10/1993 Viollaz ..... 473/378
5,553,852 A * 9/1996 Higuchi et al. ..... 473/373
5,704,854 A * 1/1998 Higuchi et al. ..... 473/373
5,782,707 A 7/1998 Yamagishi et al. ..... 473/374
5,813,924 A 9/1998 Yamagishi et al. ..... 473/377
5,830,085 A 11/1998 Higuchi et al. ..... 473/373
5,830,086 A 11/1998 Hayashi et al. ..... 473/376
5,911,639 A * 6/1999 Kasashima et al. ..... 473/377

* cited by examiner

*Primary Examiner*—Steven Wong
*Assistant Examiner*—Raeann Gorden
(74) *Attorney, Agent, or Firm*—Sughrue Mion, PLLC

(57) ABSTRACT

In a multi-piece golf ball comprising a core, an intermediate layer, and a cover, the ratio of A/B is set to be 1.10/1 or greater wherein A is a deflection under a load of 100 kg of the core and B is a deflection under a load of 100 kg of a sphere having the core enclosed with the intermediate layer, and the coefficient of restitution of the ball at a firing velocity of 25 m/s minus the coefficient of restitution of the ball at a firing velocity of 50 m/s is less than 0.100. The ball shows performance less dependent on a head speed, a distance exactly corresponding to a particular number of club used, and improved flight performance at a high head speed.

32 Claims, 1 Drawing Sheet

MULTI-PIECE GOLF BALL

This invention relates to a multi-piece golf ball of at least three layer structure.

BACKGROUND OF THE INVENTION

Because of the distance advantage, solid golf balls have replaced wound golf balls and become predominant in the golf ball art. The solid golf balls having solid cores include two-piece golf balls of two-layer structure, three-piece golf balls of three-layer structure, and multi-piece golf balls of four or more layer structure. Even though solid golf balls were deemed inferior to wound golf balls with respect to the spin performance upon approach shots, such shortcomings of solid golf balls were overcome by recent advances including the development of a soft cover.

Nevertheless, many professional golfers and low-handicap skilled golfers still favor wound golf balls. It is believed that this choice depends not only on the performance on approach shots, but also on restitution or rebound in a high head speed region. The restitution of wound golf balls is less dependent on the head speed. When hit in the high head speed region, wound golf balls experience that the reduction of restitution is small and thus travel good distance, as compared with solid golf balls. This behavior is characteristic of wound golf balls, and it is believed difficult to impart this behavior to solid golf balls.

SUMMARY OF THE INVENTION

An object of the invention is to provide a multi-piece golf ball of at least three layer structure whose performance is less dependent on a head speed and which exhibits improved flight performance in high head speed region and the accuracy of strike corresponding to a particular type of club.

The invention is directed to a multi-piece golf ball of at least three layer structure comprising a core, an intermediate layer enclosing the core, and a cover enclosing the intermediate layer. If the firing velocity used in the measurement of a coefficient of restitution (COR) and the head speed (HS) upon hitting with a given club are of the same value, the deformation behaviors of the ball upon impact are substantially identical between the measurement of COR and the club hitting. It has been found that the dependency of ball performance upon head speed is reduced as the difference between a COR value of a ball in a low HS region (typically 25 m/s) and a COR value in a high HS region (typically 50 m/s) is minimized, that is, the difference between COR upon low HS club hitting and COR upon high HS club hitting is minimized. More specifically, it has been found that when the ratio of A/B is set to be 1.10/1 or greater wherein A is a deflection (mm) under an applied load of 100 kg of the core and B is a deflection (mm) under an applied load of 100 kg of a sphere having the core enclosed with the intermediate layer, and the difference between the COR at the low firing velocity and the COR at the high firing velocity is less than 0.100, quite unexpectedly there is obtained a multi-piece golf ball whose performance is less dependent on a head speed and which exhibits improved flight performance in the high head speed region and the accuracy of strike corresponding to a particular number of club.

It has also been found that better results are obtained by specifying additional factors including the total volume of dimples in the cover, the material and Shore D hardness of the cover, the deflection of the core, and the materials of which the core and the intermediate layer are made.

Accordingly, the invention provides a multi-piece golf ball of at least three layer structure comprising a core, an intermediate layer enclosing the core, and a cover enclosing the intermediate layer. Provided that the core undergoes a deflection A (mm) under an applied load of 100 kg, and a sphere having the core enclosed with the intermediate layer undergoes a deflection B (mm) under an applied load of 100 kg, the ratio of A/B is at least 1.10/1. Provided that the ball has a first coefficient of restitution at a firing velocity of 25 in/s and a second coefficient of restitution at a firing velocity of 50 in/sl the first coefficient minus the second coefficient is less than 0.100.

The cover generally has a plurality of dimples in its surface. In one preferred embodiment, the total of dimple volumes is from 250 $mm^3$ to 450 $mm^3$, provided that the volume of each dimple is determined with respect to an imaginary spherical surface which is given on the assumption that no dimples are formed in the ball surface. Preferably, the core is composed primarily of a rubber composition, the intermediate layer is composed primarily of a thermoplastic resin, and the cover is formed of a thermoplastic resin having a Shore D hardness of up to 62. Also preferably the deflection A of the core under an applied load of 100 kg is 2.5 to 6.5 mm.

The multi-piece golf ball of the invention travels a satisfactory distance even when hit by high-head-speed players, typically professional and low-handicap golfers.

Since the performance of the ball does little depend on the head speed and the coefficient of restitution remains substantially unchanged when hit with clubs of differing numbers, the ball travels a distance exactly corresponding to a particular number of club used.

DESCRIPTION OF THE PREFERRED EMBODIMENTS

Figure 1:
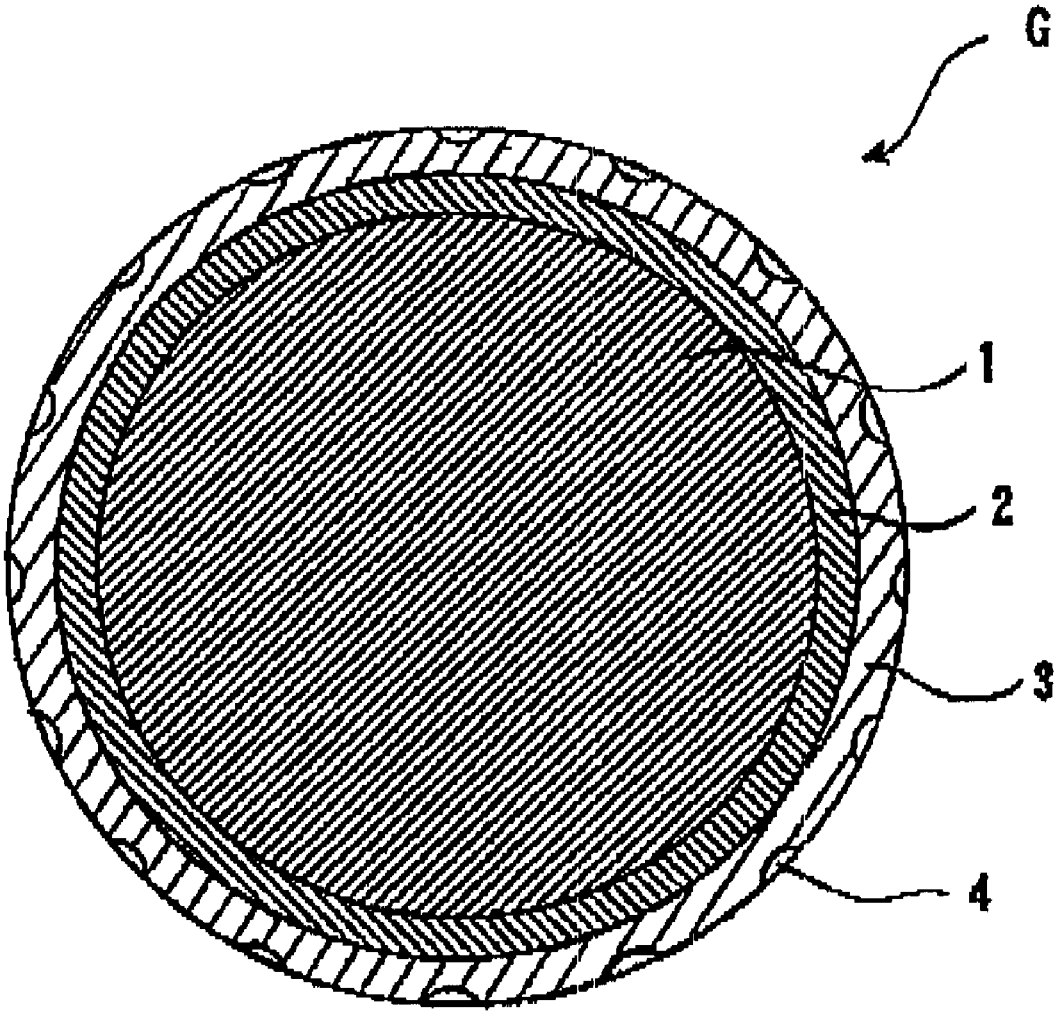
FIG. 1 is a sectional view of the multi-piece golf ball of the present invention.

The multi-piece golf ball of the invention has a multi-layer structure of at least three layers including a core, an intermediate layer enclosing the core, and a cover enclosing the intermediate layer, all in a concentric fashion. Provided that the core undergoes a deflection A (mm) under an applied load of 100 kg, and a sphere having the core enclosed with the intermediate layer undergoes a deflection B (mm) under an applied load of 100 kg, the invention requires that the ratio of A/B be at least 1.10/1 (i.e., $A/B \geqq 1.10$), preferably at least 1.20/1. The objects of the invention cannot be attained with an A/B ratio of less than 1.10.

Provided that the ball has a first coefficient of restitution (COR) at a firing velocity of 25 m/s and a second coefficient of restitution (COR) at a firing velocity of 50 m/s, the invention also requires that the first COR minus the second COR be less than 0.100 (i.e., COR@25−COR@50<0.100), preferably up to 0.095, and more preferably up to 0.090. Then the deformation behaviors of the ball upon impact become substantially identical between low and high head speeds. The dependency of ball performance upon head speed is reduced.

Coefficient of restitution (COR) is measured by firing a golf ball in a pneumatic cannon at a velocity (referred to as firing velocity) against a steel plate which is positioned apart from the muzzle of the cannon.

The rebound velocity is then measured. The rebound velocity is divided by the forward velocity to give the coefficient of restitution. A COR value which is more approximate to unity (1) indicates higher resilience.

If the above-defined difference of COR is equal to or greater than 0.100, the dependency of ball performance upon head speed becomes substantial, failing to attain the objects of the invention.

Typically the multi-piece golf ball has a COR value of 0.80 to 0.88, more preferably 0.82 to 0.87 at a firing velocity of 25 m/s, and 0.74 to 0.80, more preferably 0.74 to 0.79 at a firing velocity of 50 m/s. Beyond these ranges, there is a possibility that balls fall out of the Rules of Golf. Below these ranges, balls have poor resilience and travel short.

The multi-piece golf ball of the invention satisfying the above requirements has a multilayer structure of at least three layers. The respective layers may be formed of well-known materials.

First, the core may be formed of well-known rubber compositions. For example, a rubber composition comprising polybutadiene as the base is preferred. The polybutadiene used herein is preferably cis-1,4-polybutadiene having a cis structure of at least 40%. Where desired, another suitable rubber component such as natural rubber, polyisoprene rubber or styrene-butadiene rubber may be compounded with the polybutadiene to give the base rubber. Increasing the polybutadiene component leads to an improvement in resilience. Preferably less than about 10 parts by weight of the other rubber component is blended per 100 parts by weight of polybutadiene.

A crosslinking agent may be included in the rubber composition. Exemplary crosslinking agents are the zinc and magnesium salts of unsaturated fatty acids, such as zinc dimethacrylate and zinc diacrylate, and ester compounds such as trimethylpropane methacrylate. Zinc diacrylate is especially preferred for achieving a high resilience. The crosslinking agent is preferably included in an amount of about 10 to about 40 parts by weight per 100 parts by weight of the base rubber.

A vulcanizing agent is generally compounded in the rubber composition. Peroxides are preferred vulcanizing agents. It is recommended that the vulcanizing agent include a peroxide having a one minute half-life temperature of not higher than 155° C., and such peroxide account for at least about 30%, more preferably about 40 to 70% by weight of the entire vulcanizing agent. Examples of suitable peroxides include commercially available products such as Perhexa 3M (dicumyl peroxide, manufactured by Nippon Oils and Fats Co., Ltd.). The amount of vulcanizing agent included in the rubber composition is preferably from about 0.6 to about 2 parts by weight per 100 parts by weight of the base rubber.

If necessary, other suitable ingredients may also be incorporated in the rubber composition, such as antioxidants and fillers (e.g., zinc oxide, barium sulfate) for modifying the specific gravity. The amount of the gravity adjuster blended is typically about 1 to 30 parts by weight per 100 parts by weight of the base rubber.

Production of the core from the rubber composition may be carried out by a known method, such as one that involves molding and vulcanizing or curing steps. The core may be a single layer or have a multilayer structure of two or more layers. The core preferably has an outer diameter of 31 to 38 mm, and especially 32 to 37 mm. A core diameter of less than 31 mm may make it difficult to provide a soft feel whereas a core diameter of more than 38 mm may impose limits on the thickness of the intermediate layer and cover.

It is recommended that the core undergo a deflection of 2.5 to 6.5 mm and especially 3.0 to 6.0 mm under an applied load of 100 kg (this deflection is herein designated A). A core with a deflection of less than 2.5 mm may be too hard to mitigate the head speed dependency. A deflection in excess of 6.5 mm may lead to poor resilience.

When the core is formed to a multilayer structure of two or more layers, it suffices that the diameter and deflection of the core as a whole fall within the above-defined ranges.

The multi-piece golf ball of the invention is prepared by enclosing the above-mentioned core with the intermediate layer and then with the cover. The materials of which the intermediate layer and the cover are made may be well-known ones such as thermoplastic resins. Specific examples of suitable materials include ionomer resins and thermoplastic elastomers such as polyurethane elastomers, polyamide elastomers and polyester elastomers. A conventional injection molding process may be used in forming the intermediate layer and the cover. Each of the intermediate layer and the cover may be formed to a single layer or a multilayer structure of two or more layers.

Preferably the intermediate layer be formed primarily of a thermoplastic resin. It is preferred to use a thermoplastic resin having a Shore D hardness of 50 to 80, and especially 55 to 70. When the intermediate layer is formed around the core, the resulting sphere generally has an outer diameter of 37.5 to 40.0 mm, and especially 38.5 to 40.0 mm. As long as the diameter falls within this range, the intermediate layer may be formed to a multilayer structure of two or more layers.

It is recommended that the sphere having the core enclosed with the intermediate layer undergo a deflection of 2.2 to 5.8 mm and especially 2.6 to 5.5 mm under an applied load of 100 kg (this deflection is herein designated B). A sphere with a deflection of less than 2.2 mm may be too hard and adversely affect the feel. A sphere with a deflection in excess of 5.8 mm may be too soft and rather increase the head speed dependency.

Desirably, a thermoplastic resin having a Shore D hardness of up to 62, more preferably up to 60, and especially up to 58 is selected for the cover from among the above-listed materials. Use of a thermoplastic resin having a Shore D hardness in excess of 62 may detract from the feel and fail to provide good spin performance enough for skilled golfers to accept. The cover layer may be harder or softer than the intermediate layer. The cover layer may also be the same hardness as the intermediate layer.

The thickness or gage of the cover is not critical although the cover gage is generally 1.4 to 2.5 mm, and especially 1.5 to 2.3 mm. When the cover is formed to a structure of two or more layers, it is recommended that the cover layers as a whole have a gage within the range.

The multi-piece golf ball of the above construction preferably has a deflection of 2.0 to 3.5 mm and especially 2.2 to 3.3 mm under an applied load of 100 kg.

In the practice of the invention, the multi-piece golf ball satisfying the above-mentioned requirements of deflection ratio A/B and COR difference can be obtained by properly selecting the material type, vulcanizing conditions and diameter of the core, the material type, hardness and gage of the intermediate layer, and the material type, hardness and gage of the cover.

Like conventional golf balls, the multi-piece golf ball of the invention has numerous dimples formed in the surface of the cover. The shape and arrangement of dimples are selected as appropriate from well-known ones. Provided that the volume of each dimple is determined with respect to an imaginary spherical surface which is given on the assumption that no dimples are formed in the ball surface, the invention prefers that the total of dimple volumes be from 250 to 450 $mm^3$, and especially from 300 to 400 $mm^3$. Outside the range, the ball can sky high or fail to travel a desired distance when hit at a high head speed. With this setting of the total dimple volume, the dimples may have a diameter of 1.0 to 5.0 mm and a depth of 0.08 to 0.30 mm. The dimples may be of plural types, preferably two to six types, which are different in diameter and/or depth. The total number of dimples is typically from 300 to 450.

The inventive golf ball may be formed so as to have a diameter and weight which conform with the Rules of Golf, that is, a diameter of not less than 42.67 mm and a weight of not greater than 45.93 g.

EXAMPLE

Examples of the invention are given below by way of illustration and not by way of limitation.

Examples 1–5 and Comparative Examples 1–3

Using the materials of the formulation shown in Table 1, cores were formed, and intermediate layers and covers were sequentially formed around the cores by injection molding. In this way, there were obtained multi-piece golf balls bearing dimples with the parameters shown in Table 2.

The multi-piece golf balls were examined as follows, with the results shown in Table 1.

Total distance

Using a swing robot, the ball was hit with a driver (W#1, trade name "230Ti" with a loft 9.5°, by Bridgestone Sports Co., Ltd.) at a head speed of 48 m/s (HS48). A total distance (carry plus run) was measured.

COR

Coefficient of restitution (COR) was measured by firing the ball in a pneumatic cannon at a velocity of 25 m/s or 50 m/s against a steel plate which is positioned apart from the muzzle of the cannon. The rebound velocity was then measured. The rebound velocity is divided by the forward velocity to give the COR.

TABLE 2

| Set | Type | Diameter (mm) | Depth (mm) | $V_0$ | Number | Total volume ($mm^3$) |
|---|---|---|---|---|---|---|
| I | 1 | 4.0 | 0.20 | 0.47 | 156 | 377 |
| | 2 | 3.6 | 0.18 | 0.47 | 204 | |
| | 3 | 2.5 | 0.12 | 0.47 | 60 | |
| II | 1 | 4.0 | 0.18 | 0.47 | 156 | 337 |
| | 2 | 3.6 | 0.16 | 0.47 | 204 | |
| | 3 | 2.5 | 0.11 | 0.47 | 60 | |

Note: $V_0$ is the volume of space in a dimple below a planar surface circumscribed by the edge of the dimple divided by the volume of a cylinder whose base is the planar surface and whose height is the maximum depth of the dimple from the base.

As is evident from Table 1, the multi-piece golf ball of Comparative Example 1 is unsatisfactory in distance because of a low COR value at 50 m/s and a large COR difference. The multi-piece golf ball of Comparative Example 2 has an A/B ratio of less than 1.10. Both the multi-piece golf balls of Comparative Examples 1 and 2 show performance dependent on a head speed and travel short when hit at a high head speed. Comparative Example 3 is a two-piece golf ball whose performance is dependent on a head speed and which travels shorter than the golf balls within the scope of the invention. By contrast, the multi-piece golf balls within the scope of the invention show performance least dependent on a head speed and improved flight at a high head speed.

There has been described a multi-piece golf ball of at least three layer structure whose performance is less dependent on a head speed and which travels a distance exactly corresponding to a particular number of club used and exhibits improved flight performance especially at a high head speed.

Japanese Patent Application No. 11-094522 is incorporated herein by reference.

Although some preferred embodiments have been described, many modifications and variations may be made thereto in light of the above teachings. It is therefore to be

TABLE 1

| | | EX1 | EX2 | EX3 | EX4 | EX5 | CE1 | CE2 | CE3 |
|---|---|---|---|---|---|---|---|---|---|
| Core formulation (pbw) | Cis-1,4-polybutadiene | 100 | 100 | 100 | 100 | 100 | 100 | 100 | 100 |
| | Zinc diacrylate | 28 | 23 | 19 | 22 | 13 | 24 | 22 | 30 |
| | Zinc oxide | 24.0 | 26.0 | 27.5 | 26.5 | 30.0 | 25.0 | 26.0 | 21.5 |
| | Dicumyl peroxide | 0.9 | 0.9 | 0.9 | 0.9 | 0.9 | 0.9 | 0.9 | 0.9 |
| Intermediate layer formulation (pbw) | Himilan 1557 | 50 | — | — | 50 | — | — | — | — |
| | Himilan 1605 | 50 | — | — | 50 | — | — | — | — |
| | Himilan 7315 | — | 50 | 50 | — | 50 | — | — | — |
| | Surlyn 8220 | — | 50 | 50 | — | 50 | — | — | — |
| | Hytrel 4767 | — | — | — | — | — | 100 | 100 | — |
| Cover formulation (pbw) | Himilan 1601 | — | — | 50 | 50 | 50 | — | 50 | — |
| | Himilan 1557 | 60 | 60 | 50 | 50 | 50 | 60 | 50 | 60 |
| | Surlyn 8120 | 40 | 40 | — | — | — | 40 | — | 40 |
| Core diameter (mm) | | 35.2 | 35.2 | 35.2 | 35.2 | 35.2 | 35.2 | 35.2 | 39.0 |
| Sphere diameter (mm) | | 39.0 | 39.0 | 39.0 | 39.0 | 39.0 | 39.0 | 39.0 | — |
| Deflection under 100-kg load | Core: A (mm) | 3.14 | 3.73 | 4.50 | 3.99 | 5.64 | 3.58 | 3.96 | 2.82 |
| | Sphere: B (mm) | 2.61 | 2.72 | 3.45 | 2.89 | 3.78 | 3.16 | 3.80 | — |
| | A/B | 1.20 | 1.37 | 1.30 | 1.38 | 1.49 | 1.13 | 1.04 | — |
| Shore D hardness | Intermediate layer | 60 | 67 | 67 | 60 | 67 | 47 | 47 | — |
| | Cover | 50 | 50 | 58 | 58 | 58 | 50 | 58 | 50 |
| Dimples | Set | I | I | II | II | II | I | II | I |
| | Total volume ($mm^3$) | 377 | 377 | 337 | 337 | 337 | 377 | 337 | 377 |
| COR | @25 m/s | 0.845 | 0.830 | 0.853 | 0.820 | 0.831 | 0.848 | 0.850 | 0.845 |
| | @50 m/s | 0.760 | 0.748 | 0.770 | 0.750 | 0.754 | 0.738 | 0.735 | 0.730 |
| | @25 m/s − @50 m/s | 0.085 | 0.082 | 0.083 | 0.070 | 0.077 | 0.110 | 0.115 | 0.115 |
| Total distance W#1/HS48 (m) | | 251.5 | 253.0 | 254.2 | 255.0 | 251.0 | 245.0 | 248.5 | 248.2 |

Note: The sphere is the core enclosed with the intermediate layer.

Himilan is the trade name of ionomer resins, Surlyn is the trade name of ionomer resins, and Hytrel is the trade name of polyester elastomers, all available from E. I. DuPont de Nemours and Company.

understood that the invention may be practiced otherwise than as specifically described without departing from the scope of the appended claims.

What is claimed is:

1. A multi-piece golf ball of at least three layer structure comprising a core composed primarily of a rubber composition, an intermediate layer composed primarily of a thermoplastic resin enclosing the core, and a cover formed of a thermoplastic resin enclosing the intermediate layer, wherein the core undergoes a deflection A (mm) under an applied load of 100 kg, and a sphere having the core enclosed with the intermediate layer undergoes a deflection B (mm) under an applied load of 100 kg, the ratio of A/B is at least 1.10/1, the ball has a first coefficient of restitution at a firing velocity of 25 m/s and a second coefficient of restitution at a filing velocity of 50 m/s, and the first coefficient minus the second coefficient is less than 0.100;

wherein the cover has a plurality of dimples iD its surface, and the total of dimple volumes is from 250 $mm^3$ to 450 $mm^3$, provided that the volume of each dimple is determined with respect to an imaginary spherical surface which is given on the assumption that no dimples are formed in the ball surface, wherein the dimples have a diameter of 1.0 to 5.0 mm and a depth of 0.08 to 0.30 mm; and wherein two to six types of dimples are formed on the cover, each of the types is different in diameter and/or depth, and the total number of the dimples is 300 to 450.

2. The multi-piece golf ball of claim 1 wherein the cover has Shore D hardness of up to 62.

3. The multi-piece golf ball of claim 1 wherein the deflection A of the core under an applied load of 100 kg is 2.5 to 6.5 mm.

4. The multi-piece golf ball of claim 1 wherein the intermediate layer has a Shore D hardness of 50 to 80.

5. The multi-piece golf ball of claim 1 wherein the intermediate layer is formed of materials selected from ionomer resins, polyurethane elastomers, polyamide elastomers and polyester elastomers.

6. The multi-piece golf ball of claim 1 wherein the intermediate layer is formed around the core, the resulting sphere has an outer diameter of 37.5 to 40.0 mm.

7. The multi-piece golf ball of claim 1 wherein the cover is formed of materials selected from ionomer resins, polyurethane elastomers, polyamide elastomers and polyester elastomers.

8. The multi-piece golf ball of claim 1 wherein zinc oxide or barium sulfate is incorporated in the rubber composition in a range of 1 to 30 parts by weight per 100 parts by weight of the base rubber.

9. A multi-piece golf ball of at least three layer structure comprising a core composed primarily of a rubber composition, an intermediate layer composed primarily of a thermoplastic resin enclosing the core and a cover formed of a thermoplastic resin enclosing the intermediate layer, wherein the core undergoes a deflection A (mm) under an applied load of 100 kg, and the intermediate layer has a Shore D hardness larger than that of the cover, and a sphere having the core enclosed with the intermediate layer undergoes a deflection a (mm) under an applied load of 100 kg, the ratio of A/B is at least 1.10/1, the ball has a first coefficient of restitution at a firing velocity of 25 m/s and a second coefficient of restitution at a firing velocity of 50 m/s. and the first coefficient minus the second coefficient is less than 0.100.

10. The multi-piece golf ball of claim 9 wherein the intermediate layer has a Shore D hardness of 50 to 80 and the cover has a Shore D hardness of up to 62.

11. The multi-piece golf ball of claim 9 wherein the cover has a plurality of dimples in its surface, and the total of dimple volumes is from 250 $mm^3$ to 450 $mm^3$, provided that the volume of each dimple is determined with respect to an imaginary spherical surface which is given on the assumption that no dimples are formed in the ball surface.

12. The multi-piece golf ball of claim 9 wherein the cover has Shore D hardness of up to 62.

13. The multi-piece golf ball of claim 9 wherein the deflection A of the core under an applied load of 100 kg is 2.5 to 6.5 mm.

14. The multi-piece golf ball of claim 9 wherein the intermediate layer has a Shore D hardness of 50 to 80.

15. The multi-piece golf ball of claim 9 wherein the intermediate layer is formed of materials selected from ionomer resins, polyurethane elastomers, polyamide elastomers and polyester elastomers.

16. The multi-piece golf ball of claim 9 wherein the intermediate layer is formed around the core, the resulting sphere has an outer diameter of 37.5 to 40.0 mm.

17. The multi-piece golf ball of claim 9 wherein the cover is formed of materials selected from ionomer resins, polyurethane elastomers, polyamide elastomers and polyester elastomers.

18. The multi-piece golf ball of claim 9 wherein zinc oxide or barium sulfate is incorporated in the rubber composition in a range of 1 to 30 parts by weight per 100 parts by weight of the base rubber.

19. The multi-piece golf ball of claim 11 wherein the dimples have a diameter of 1.0 to 5.0 mm and a depth of 0.08 to 0.30 mm.

20. The multi-piece golf ball of claim 19 wherein the dimples are used with two to six types, which are different in diameter and/or depth and the total number of the dimples is 300 to 450.

21. A multi-piece golf ball of at least three layer structure comprising a core composed primarily of a rubber composition, an intermediate layer composed primarily of a thermoplastic resin enclosing the core and a cover formed of a thermoplastic resin enclosing the intermediate layer, wherein the core undergoes a deflection A (mm) under an applied load of 100 kg, and the intermediate layer has a Shore D hardiness of 50 to 80 and a sphere having the core enclosed with the intermediate layer undergoes a deflection B (mm) under an applied load of 100 kg, the ratio of A/B is at least 1.10/1, the cover has a Shore D hardness of up to 62 which is smaller than that of the intermediate layer, and the ball has a first coefficient of restitution at a firing velocity of 25 m/s and a second coefficient of restitution at a firing velocity of 50 m/s. and the first coefficient minus the second coefficient is less than 0.100.

22. The multi-piece golf ball of claim 21 wherein the cover has a plurality of dimples in its surface, and the total of dimple volumes is from 250 $mm^3$ to 450 $mm^3$, provided that the volume of each dimple is determined with respect to an imaginary spherical surface which is given on the assumption that no dimples are formed in the ball surface.

23. The multi-piece golf ball of claim 21 wherein the cover has Shore D hardness of up to about 58.

24. The multi-piece golf ball of claim 21 wherein the deflection A of the core under an applied load of 100 kg is 2.5 to 6.5 mm.

25. The multi-piece golf ball of claim 21 wherein the intermediate layer has a Shore D hardness of about 60 to 67.

26. The multi-piece golf ball of claim 21 wherein the intermediate layer is formed of materials selected from ionomer resins, polyurethane elastomers, polyamide elastomers and polyester elastomers.

27. The multi-piece golf ball of claim 21 wherein the intermediate layer is formed around the core, the resulting sphere has an outer diameter of 37.5 to 40.0 mm.

28. The multi-piece golf ball of claim 21 wherein the cover is formed of materials selected from ionomer resins, polyurethane elastomers, polyamide elastomers and polyester elastomers.

29. The multi-piece golf ball of claim 21 wherein zinc oxide or barium sulfate is incorporated in the rubber composition in a range of 1 to 30 parts by weight per 100 parts by weight of the base rubber.

30. The multi-piece golf ball of claim 22 wherein the dimples have a diameter of 1.0 to 5.0 mm and a depth of 0.08 to 0.30 mm.

31. The multi-piece golf ball of claim 30 wherein the dimples are used with two to six types, which are different in diameter and/or depth and the total number of the dimples is 300 to 450.

32. The multi-piece golf ball of claim 21 wherein the intermediate layer has a Shore D hardness of 60 to 67 and the cover has a Shore D hardness of up to about 58.

* * * * *